United States Patent [19]

Horvath

[11] 4,097,275

[45] Jun. 27, 1978

[54] CEMENTED CARBIDE METAL ALLOY CONTAINING AUXILIARY METAL, AND PROCESS FOR ITS MANUFACTURE

[76] Inventor: Erich Horvath, Friedrich-Eckkard-Str. 21, 8 Munich 81, Germany

[21] Appl. No.: 683,305

[22] Filed: May 5, 1976

Related U.S. Application Data

[63] Continuation of Ser. No. 376,354, Jul. 5, 1973, abandoned.

[51] Int. Cl.[2] ..... B22F 3/12; C22C 1/05

[52] U.S. Cl. ..... 75/203; 75/204; 75/242; 75/246

[58] Field of Search ..... 29/182.2, 29/182.4; 75/242, 246, 203, 204

[56] References Cited

U.S. PATENT DOCUMENTS

| | | | |
|---|---|---|---|
| 3,053,706 | 9/1962 | Gregory et al. | 29/182.8 |
| 3,676,084 | 7/1972 | Quatinetz et al. | 29/182.8 |

*Primary Examiner*—Richard E. Schafer

[57] ABSTRACT

A cemented carbide metal alloy containing auxiliary metal having one or more finely dispersed carbide phases and process for making the same.

The invention relates to a cemented carbide metal alloy containing auxiliary metal with one or more finely dispersed carbide phases and a process for making such carbide metal alloy.

11 Claims, 1 Drawing Figure

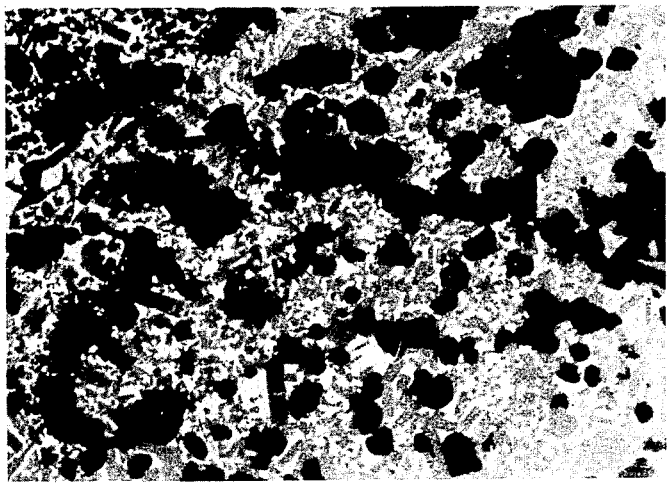

CEMENTED CARBIDE METAL ALLOY CONTAINING AUXILIARY METAL, AND PROCESS FOR ITS MANUFACTURE

This is a Continuation Application of Ser. No. 376,354, filed July 5, 1973, now abandoned. According to the state of the art sintered hard metals comprise carbides or mixed-crystal carbides being responsible for hardness and wear-resistance and a binding metal or binding metal alloy being responsible for toughness and strength. Suitable binding metals or binding metal alloys are iron, cobalt, nickel or nickel-molybdenum. It is well known that with a rising content of binding metal the hardness of the conventional cemented carbide metals decreases, while on the other hand their toughness and strength increases. It is furthermore known that with a given content of binding metal the hardness of the alloy increases, the bending strength remaining constant and the grain size decreasing. In alloys that display an extremely fine-grained structure, it has surprisingly now been found that these alloys attain very much higher bending strengths in relation to conventional carbide metals, with the same hardness. This finding has led to attempts at making carbides with submicron grain size, which can subsequently be employed in the manufacture of cemented carbide metals. As it proved to be difficult, by grinding processes or other methods of comminution, such as are generally used in the manufacture of carbide metals, to obtain a further reduction in the grain size of the carbide powders thereby obtained, processes have been developed for making carbide powders having grain sizes smaller than 1 micron, i.e., the so-called sub-micron carbides, without having to resort to direct mechanical comminution. Such a process has for instance, become known by the term "plasma spraying". In this latter, between a water cooled copper electrode and a tungsten electrode, a plasma arc is produced, to which metal halides and hydrocarbons, for instance methane are fed from the outside. The metal halides react with the hydrocarbons in the plasma arc to form carbides, which are then quenched in the container to some extent in statu nascendi, in which the plasma gun operates. The grain size of the carbides thus produced ranges between 0.01 and 0.1 micron. The carbides, however, are always contaminated by free carbon and also by oxygen. During sintering these ultra-fine carbides tend to show pronounced grain growth, which can be inhibited by additions of VC and NbC. Carbide metals produced from submicron carbides are therefore always very much more coarse-grained than the original components.

It is furthermore well known that fine-grained carbide metals free of ferrous metal and containing refractory binding metals can be made by thermally produced disproportioning of homogeneous mixed crystals of bimetallic carbides on the one hand and by the separation of fine-grained monocarbides from a eutectic melt on the other. Such metals have, however, so far not been found suitable for much technical use.

It is furthermore known that methane or carbon and hydrogen according to the methane gas equilibrium, can be used for carburizing undesirably sub-carbided carbide metal charges, in order to avoid the formation of $\eta$-carbide with its well known undesirable effects. It is furthermore well known that carbides can be prepared from metals or metal oxides by gas-phase carburizing using therefor gases containing hydrocarbons. This process also has not gained any significance according to the state of the art as compared with the usual methods of making carbides.

An object of this invention is to provide a sintered carbide metal alloy containing auxiliary metal having one or more finely dispersed carbide phases possessed of excellent hardness and bending strength properties.

A further object of the instant invention is to provide a method of making carbide metal alloys with submicron carbide structure without having to start from a hard metal charge of sub-micron carbides.

These and other objects are obtained in accordance with the invention by providing that the mean grain size of at least one of the carbide phases in the sintered carbide metal is smaller than the mean particle size of the portions of the hard metal charge forming this carbide phase, or by providing that the mean grain size of the carbide phase in the sintered hard metal amounts to about 1/10 of the mean particle size of the fractions of the hard metal charge forming this phase.

According to the invention, such carbide metal alloy is prepared by a process wherein the carbide metal charge is carburized in the form of powder or cold pressed moldings via the gas phase at normal, excess or reduced pressure, or alternatively the carbide metal charge is carburized in the form of powder or cold-compressed moldings with hydrogen in the presence of carbon according to the methane gas equilibrium by mixing the charge powder or by embedding the moldings in carbon at normal, excess or reduced pressure.

In the process of the invention metals and/or sub-carbides and/or hydrides of the elements 4a (Ti, Zr, Hf), 5a (V, Nb, Ta), 6a (Cr, Mo, W) and/or n carbides thereof in a ground mixture with binding metals or binding metal alloys are carburized by chemical reaction of carbon via the gas phase to form stable, highly carburized carbides, generally monocarbides, and can then be sintered to form carbide metals. This carburizing reaction develops in a special way due to the fine grained nature (1-2 microns) and the high surface activity of the solid reaction partner on the one hand, and due to the presence of binding metals (iron, nickel, cobalt) on the other, which act as cracking catalysts for the carburizing agent, i.e., methane that is preferably employed.

It is most surprising to find that the carbide metal alloys produced in this way display a particularly finely dispersed carbide structure.

The particle size of the carbide phase resulting from the process according to the invention in the carbide metal is, in spite of the well known considerable grain growth which takes place in sintering, up to the power of 10 below the grain size of the particles of the hard metal charge before gas phase carburizing and sintering.

The sole FIGURE is a photomicrograph of the sintered, carbide-metal alloy according to the practice of the invention.

If now, metal powder and/or sub-carbides and/or hydrides and/or eta-carbides of the elements Ti, Zr, Hf, V, Nb, Ta, Cr, Mo, W of the order of magnitude of the particles of 1 micron which are obtainable by the well known comminution processes, are subjected to the process according to the invention, the particle size of the finely dispersed carbide phase, after carburization in the sintered carbide metal, will be of the order of 0.1 micron.

The finely dispersed carbide particles do not display any skeletal formation such as is often observed in other hard metal structures; indeed, the carbide particles are sheathed by the binding metal phase.

Carbide metal charges according to the invention are, in contrast to well known sub-micron carbide powder charges, largely impervious to atmospheric oxidation, which leads to wetting difficulties, and therefore such charges do not call for any special measures during processing.

According to the principle of the invention, the drastic reduction in grain size during the carburization and sintering of the carbide metal charges takes place by a so-called "chemical comminution", which comes about when the finely-dispersed, highly carburized and stable carbide phase of the densely sintered hard metal in the carbide metal charge was originally present in a radiographically different lattice modification. The phase transformation due to the reaction of carbon, i.e., from dimetallic carbides to monocarbides, leads to stresses and to the formation of micro-fissures within the crystal. The liquid binder phase occurring in the sintering process, owing to the capillary forces that become effective because of the excellent wettability of the newly formed surface, infiltrate into the micro-fissurres, and this has the effect that the disintegration of the body of the crystal takes place. The micro-crystallites produced from the original crystal occur largely individually in the binder matrix as may be seen from the FIGURE of the drawing forming a part of this disclosure without any agglomerates being formed.

The important advance according to the invention, in relation to the usual processes of manufacture of carbide metals, in particular of sub-micron carbide metals, is accordingly obtained by the advantageous comminution during the sintering process. Here, the comminution of the crystal and the wetting of the newly formed surface of the micro-crystallites, free from oxygen, by the binder take place in one operation.

According to the process of the invention charges for making carbide metal from dimetallic carbides and/or their mixed crystals and/or elements *4a, 5a, 6a* and/or their alloys, and/or hydrides, and/or eta-carbides or mixtures thereof, alone or with subsequent addition of the binding metal or the binding metal alloy, or even with immediate supply of the binding metal or the binding metal alloy, are comminuted in the well known manner, and preferably for 48 to 70 hours in ball mills, or for 12 to 24 hours in stirring mechanism ball mills by the wet grinding process. These mixtures of powders correspond in their elementary composition, with the exception of the carbon content, to the composition of the desired hard metal. These mixtures are either compressed to form hard metal blanks in the well known manner and flux or else the hard metal charge powder, the latter preferably in a hydrocarbon, preferably methane or mixtures thereof with hydrogen or inert gas such as argon, at temperatures between 700° and 1100° C, and preferably between 750° and 850° C until the desired absorption of carbon takes place, preferably for 2–3 hours.

The content of hydrocarbons in hydrogen or the inert gas is between 2 to 80% by weight, preferably between 5 and 30% by weight.

On the other hand, according to an advantageous development of the invention, the carbide metal blanks or powdered mixtures in the presence of hydrogen and carbon, preferably under pressure, are carburized at a temperature of between 800° and 1100° C, most preferably between 850° and 950° C until the desired carbon content is reached. The special advantage of this process resides in the fact that owing to the theoretical bases of the methane gas equilibrium, no free carbon can be precipitated. A carbon absorption exceeding the desired degree cannot therefore occur.

The carburization of the carbide metal blanks is followed by sintering in the usual way, and preferably in the same apparatus. The carburized hard metal charge powder, on the other hand, is compressed in the cold state and usually processed according to the single or double sintering process.

The invention is illustrated in further detail by the following examples, a structural micrograph being appended to Example 2. The examples are, however, in no wise to be construed as a limitation of the scope of the invention.

The following examples are to demonstrate the preparation according to the invention of sintered hard metals having a final composition as specified in the ASTM standards under the application grades C1–C14. Additionally these examples refer to hard metals comprising titanium carbide, circonium carbide, hafnium carbide, vanadium carbide, columbium carbide, chromium carbide, molybdenum dicarbide cited in "Hartmetalle" by R. Kieffer, F. Benesovsky; Springer Verlag Heidelberg, New York, Wien.

EXAMPLE 1

A mixture of 89.7% by weight $W_2C$ and 10.3% by weight Co is ground with the addition of 1.2% by weight of a compression aid (stearic acid) in a ball mill under hexane for 60 hours and then after vacuum drying compressed at a pressure of 0.8 t/cm$^2$ to form molded plates with the dimensions 14 × 14 × 4 mm or small rods having the dimensions 60 × 5 × 5 mm. The moldings are freed from wax in the usual way under hydrogen and warmed in a vacuum sintering furnace at $10^{-3}$ Torr within an hour to 800° C. At that temperature, within a further 2 hours, the quantity of methane required for carburizing $W_2C$ to WC is supplied to the vacuum. The quantity which is required is 3.7 – 4.0 parts by weight methane for 100 parts by weight hard metal mixture. After a further period of carburization of one hour, sintering is carried out in a high vacuum at a temperature of 1320° C for 60 minutes.

The composition of the hard metals obtained after carburization and sintering was 90% by weight WC and 10% by weight Co and the density 14.6 g/cm$^3$. With a hardness of 1650–1700 kp/mm$^2$ Hv, bending strengths of 290 kp/mm$^2$ were obtained.

EXAMPLE 2

A mixture of 11.1% by weight TiC, 76.9% by weight W and 12.0% by weight Ni was ground for 24 hours in a stirring mechanism ball mill with the addition of a suitable grinding fluid such as benzene. The binding metal was only added after a period of 20 hours of grinding.

The dried powder mixture thus obtained was heated in a resistance-heated furnace in a stream of hydrogen to 770° C. At that temperature 15% by volume methane was admixed, the carburizing process carried out under movement of the powder charge by a stirring device to obtain the desired absorption of carbon, and after carburization, cooled in the stream of hydrogen. The quantity of methane which is required is 3.1 – 3.4 parts by weight methane for 100 parts by weight hard metal mixture. The carburized carbide metal charge was treated with a compression aid, compressed and then sintered in a vacuum at 1350° C for 90 minutes. The composition of the hard metals obtained following carburization and sintering was 10.5% by weight Tic, 78.1% by weight WC and 11.4% by weight Ni.

With a hardness of 1870 kp/mm² HV, bending strengths of 190–210 kp/mm² were obtained. Cutting tests were performed on a heat-resistent Ni base alloy, known by the name of Incoloy 901 (AMS 5660A) in the form of cylindrical bars with a ⅛ of 100 mm and a length of 500 mm. The peripheral speed was 30m/min, depth of cut 0.5 mm, feed 0.05 mm/revolution. Tool geometry: $\gamma,\gamma_n,\alpha,\alpha_n,\gamma,\phi,\nu$; $0^P$, $0^N$, $5^N$, $5^N$, 15, 15, $0.5^K$[m,m].

As tools for comparison, carbide metals of the types K 10 and P 20 (ISO standards) were taken. The tool lives were determined with a wear of the free surface of 0.4 mm.

| | | |
|---|---|---|
| P 20 | tool life (min) | 2 |
| K 10 | " | 4 |
| WC-TiC-Ni | " | 10 |

The structure shows extremely fine grained WC and coarser TiC which was not subject to "chemical comminution".

EXAMPLE 3

A mixture of 11.1% by weight TiC, 76.9% by weight W and 12.0% by weight Co was ground with the addition of compression aids and grinding fluid for 24 hours in a stirring mechanism ball mill, and the dried powder mixture was compressed to form tool tips and rods. The blanks were freed from wax in the usual way and warmed in a vacuum sintering furnace, embedded in graphite, within an hour to 940° C. At that pressure, hydrogen was supplied at a pressure of 1.5 atmospheres pressure and carburization took place for 10 hours. Sintering was then carried out in a high vacuum at 1310° C for 90 minutes.

The composition of the carbide metals obtained after carburizing and sintering was 10.5% by weight TiC, 78.1% by weight WC and 11.4% by weight Co.

With a hardness of HV 1820 kp/mm², bending strengths of 200–220 kp/mm² were obtained.

EXAMPLE 4

A mixture of 5.0% by weight Ti, 70.5% by weight $W_2C$, 14.1% by weight $Ta_2C$ mixed crystal and 10.4% by weight Co is ground with the addition of a compression aid and grinding fluid for 72 hours in a ball mill and after drying compressed to form tool bits and rods. The briquettes are freed from wax in the usual way and, embedded in graphite, heated in a resistance-heated furnace in a stream of hydrogen within an hour to 900° C.

At that temperature, carburization took place in a stationary atmosphere of hydrogen according to the methane equilibrium for 36 hours. Sintering then took place in a stream of hydrogen at 1320° C for 60 minutes.

The composition of the carbide metals obtained after carburizing and cementing was 6.0% by weight TiC, 14% by weight TaC, 70% by weight WC and 10% by weight Co and the density 12.7 g/cm³.

With a hardness of 1650 kp/mm², bending strengths of 180–200 kp/mm² were obtained.

EXAMPLE 5

A mixture of 15.3% by weight Ti, 10.65% by weight Co, and 74.05% by weight mixed cristal containing 83.4% by weight $W_2C$ and 16.6% by weight $Ta_2C$ is wet ground and after drying compressed to form tool tips and small rods. The briquettes are carburized for 6 hours with methane at 850° C until the required absorption of carbon has been obtained. The quality of methane required is 8.15 to 9 parts by weight for 100 parts by weight hard metal mixture. Sintering then took place for two hours at 1450° C.

The composition of the hard metals obtained after carburizing and sintering was 18% by weight TiC, 12% by weight TaC, 60% by weight WC and 10% by weight Co.

With a hardness of 1750 kp/mm² HV, bending strengths of 160 to 180 kp/mm² are obtained.

The comparative values for a classically manufactured alloy of the same composition are hardness: 1650 kp/mm² HV and bending strength 130–150 kp/mm².

EXAMPLE 6

A mixture of 71.2% by weight Ti, 14.0% Mo and 14.8% by weight Ni was ground with the addition of a grinding fluid for 2 hours in a stirring mechanism ball mill.

The dried powder mixture was warmed in a vacuum sintering furnace at $10^{-3}$ Toor to 820° C and the required quantity of methane for carburization was supplied within 2 hours. The quantity of methane required is 21.4 to 28.0 parts by weight methane for 100 parts by weight hard metal mixture. After a further period of carburization of 2 hours at that temperature, cooling took place in a vacuum.

The carburized hard metal charge was homogenized with 4.2% by weight Mo powder and treated with compression aids, compressed to form cemented plates and bars and then sintered in a vacuum at 1420° C for 60 minutes.

The composition of the carbide metals obtained after carburizing and sintering was 72% by weight TiC, 12% by weight $Mo_2C$, 4% by weight Mo and 12% by weight Ni. With a hardness of 1800 kp/mm², bending strengths up to 170 kp/mm² were obtained.

EXAMPLE 7

A mixture of 93% by weight $Co_2W_4C$ ($\eta$carbide), 5.0% by weight $Ta_2C$ and 2.0% by weight Co and a compression aid was ground with the addition of a grinding fluid for 20 hours in a stirring mechanism ball mill and the dried powder mixture was compressed to form tool bits and small rods. The briquettes were freed from wax in the usual way and warmed in a resistance-heated furnace to 860° C. At that temperature 10% by volume methane was mixed with the hydrogen and carburizing took place until the desired amount of carbon had been absorbed.

Sintering then took place in a stream of hydrogen at 1300° C for 20 minutes.

The composition of the carbide metals obtained after carburizing and sintering was 81.0% by weight WC, 5.0% by weight TaC and 14.0% by weight Co.

With a hardness of 1600 kp/mm² HV, bending strengths of 210–220 kp/mm² were obtained.

What we claim is:

1. A process for making a sintered carbide-metal alloy containing submicronic carbide particles comprising the steps of:

forming a mixture of a carbide-forming charge selected from the group consisting of the dimetallic carbides, hydrides, eta carbides and elemental metals of groups 4a, 5a and 6a of the periodic table and their mixtures and a binding metal powder selected from the group consisting of iron, cobalt, nickel and their mixtures;

converting said carbide-forming charge to a carbide or carbides having a crystal structure different than the crystal structure of the carbide-forming charge by subjecting the carbide-forming charge-binder metal mixture to a gaseous carbon containing carburizing atmosphere at a temperature of 700 to 1100° C; and liquid-phase sintering the thus formed carbide-binder metal to wet and split the carbide to form submicronic carbide particles.

2. The process according to claim 1, wherein methane is employed in the carburizing gas atmosphere.

3. The process according to claim 1, wherein hydrogen is employed in the carburizing gas atmosphere.

4. The process according to claim 1, wherein said carbide forming charge is in powder form and consists of at least one member of the group of dimetallic carbides and dimetallic carbide mixed crystals of elements of the groups *4a, 5a* and *6a.*

5. The process according to claim 1, wherein said carbide forming charge is in powder form and consists of at least one member of the group consisting of metals and metal alloys of elements of the groups *4a, 5a* and *6a.*

6. The process according to claim 1, wherein said carbide forming charge is in powder form and consists of hydrides of elements of the groups *4a, 5a* and *6a.*

7. The process according to claim 1, wherein said carbide forming charge is in powder form and consists of eta-carbides of elements of the groups *4a, 5a* and *6a* and mixtures thereof.

8. The process according to claim 1, wherein said mixture of a carbide forming charge and a binding metal powder is in powder form and additionally contains at least one member of the group consisting of monocarbides of the elements of the groups *4a, 5a* and *6a.*

9. The process according to claim 1, wherein said liquid-phase sintering step is effected at a temperature not higher than substantially 1450° C.

10. The process according to claim 1, wherein said converting step is effected at a temperature within the range of from 850° to 950° C and said liquid-phase sintering step is effected at a temperature not higher than substantially 1450° C.

11. The process according to claim 1, wherein said converting step is effected by embedding a molding of said carbide-forming charge-binder metal mixture in carbon at normal, excess or reduced pressure.

* * * * *